US010119708B2

(12) United States Patent
Bartelick et al.

(10) Patent No.: US 10,119,708 B2
(45) Date of Patent: Nov. 6, 2018

(54) OVEN WITH AUTOMATIC OPEN/CLOSED SYSTEM MODE CONTROL

(71) Applicant: Alto-Shaam, Inc., Menomonee Falls, WI (US)

(72) Inventors: Janus Bartelick, Germantown, WI (US); J. K. Raghavan, Mequon, WI (US); Steve Maahs, Hartland, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 1066 days.

(21) Appl. No.: 13/868,423

(22) Filed: Apr. 23, 2013

(65) Prior Publication Data

US 2014/0311360 A1 Oct. 23, 2014

(51) Int. Cl.

| | |
|---|---|
| ***F24C 15/32*** | (2006.01) |
| ***F24C 3/12*** | (2006.01) |
| ***F24C 7/08*** | (2006.01) |

(52) U.S. Cl.

CPC ..... *F24C 15/327* (2013.01); *F24C 3/124* (2013.01); *F24C 7/085* (2013.01); *F24C 15/325* (2013.01)

(58) Field of Classification Search

CPC ..... F24C 3/124; F24C 7/085; F24C 15/327; F24C 15/325; F24C 15/322; F24C 15/2035; F24C 15/2007

USPC ..... 99/468, 480; 219/400, 401; 126/21 A

See application file for complete search history.

(56) References Cited

U.S. PATENT DOCUMENTS 1,515,234 A * 11/1924 Woodson ..... F24C 15/2007 126/275 E
1,518,487 A * 12/1924 Culbertson ..... F24B 1/1915 126/15 A
1,637,427 A * 8/1927 Riches ..... A21B 1/22 219/394
1,664,443 A * 4/1928 Williams ..... A21B 1/40 126/19 R
1,890,681 A * 12/1932 Hoppe ..... A21B 1/28 126/21 A
2,060,992 A * 11/1936 Jackson ..... A23B 4/052 126/20
2,123,040 A * 7/1938 Hanak ..... A23B 4/052 99/343
2,143,994 A * 1/1939 McGlone ..... F24C 1/14 126/1 R
2,352,590 A * 6/1944 Trinkle ..... A23B 4/052 126/21 A
2,410,285 A * 10/1946 Herbster ..... F24C 15/322 126/39 C
2,640,414 A * 6/1953 Jensen ..... A23B 4/052 110/122
2,750,680 A * 6/1956 Houdry ..... A23B 4/031 126/21 A
2,790,380 A * 4/1957 Shryack ..... A23B 4/052 126/25 R (Continued)

*Primary Examiner* — Eric Stapleton
(74) *Attorney, Agent, or Firm* — Boyle Fredrickson S.C.

(57) ABSTRACT

A commercial oven, such as a combination oven providing steam and convection heating, may provide for motorized dampers allowing the oven to move automatically between a closed-state high humidity operating mode and an open-state low humidity operating mode according to user input reflecting a desired cooking process. The dampers operate with a conventional steam trap and may provide integrated bypass valves preventing over or under pressure of the cooking volume.

18 Claims, 4 Drawing Sheets

(56) References Cited

U.S. PATENT DOCUMENTS 2,817,506 A * 12/1957 Albright ..... F26B 15/085 126/21 A
2,862,095 A * 11/1958 Scofield ..... F24C 15/2014 126/21 A
2,897,812 A * 8/1959 Albrecht ..... A47B 77/10 126/19 M
2,908,234 A * 10/1959 Naylor ..... A21B 1/48 126/21 A
3,041,959 A * 7/1962 Oyler ..... A47J 37/06 126/273 R
3,051,158 A * 8/1962 Kimberley ..... F24C 15/2007 126/21 A
3,087,414 A * 4/1963 Gannon ..... F24B 1/202 126/25 R
3,131,688 A * 5/1964 Lipstein ..... F24C 15/2007 126/21 A
3,142,748 A * 7/1964 Warren ..... F24C 15/325 126/216
3,156,812 A * 11/1964 Forman ..... B65B 53/06 219/388
3,211,892 A * 10/1965 Swenson et al. ..... F27D 11/02 219/400
3,266,409 A * 8/1966 Oyler ..... A47J 37/06 126/19 R
3,279,452 A * 10/1966 Hottenroth ..... F24C 1/16 126/25 R
3,284,070 A * 11/1966 Nishida ..... C21B 9/00 137/310
3,326,201 A * 6/1967 Murray ..... A47J 37/06 110/309
3,328,560 A * 6/1967 Dills ..... F24C 15/2007 126/21 A
3,416,509 A * 12/1968 Huebler ..... F24C 14/025 126/21 A
3,417,742 A * 12/1968 Perl ..... F24C 14/025 126/21 A
3,447,529 A * 6/1969 Kump ..... A47J 37/0857 126/19.5
3,491,678 A * 1/1970 Oyler ..... A23B 4/052 99/357
3,528,399 A * 9/1970 Perl ..... F24C 14/025 126/21 A
3,587,555 A * 6/1971 Cerols ..... F24C 15/18 126/1 R
3,608,505 A * 9/1971 Rosenberg ..... F28D 17/00 110/212
3,659,578 A * 5/1972 Davis ..... F24C 14/02 126/21 R
3,682,156 A * 8/1972 Perl ..... F24C 15/2007 126/21 A
3,782,892 A * 1/1974 Johnson ..... A21B 1/44 126/21 A
3,807,383 A * 4/1974 Lawler ..... F26B 21/00 126/21 A
3,887,716 A * 6/1975 Seelbach ..... A23B 4/044 219/400
3,958,552 A * 5/1976 Lawler ..... B01J 6/00 126/21 A
3,961,571 A * 6/1976 Decuir ..... A23B 4/052 99/352
3,977,387 A * 8/1976 Lawler ..... F27D 19/00 126/21 A
3,978,238 A * 8/1976 Frey ..... A47J 27/004 426/412
4,039,776 A * 8/1977 Roderick ..... A21B 1/10 126/21 A
RE29,602 E * 4/1978 Perl ..... F24C 14/025 126/21 A
4,088,180 A * 5/1978 Tsai ..... C03B 5/237 165/9.3
4,094,297 A * 6/1978 Ballentine ..... F24C 3/067 126/39 J
4,114,589 A * 9/1978 Berlik ..... F24C 15/2007 126/21 R
4,135,179 A * 1/1979 Snyder ..... G01K 7/18 338/25
4,208,572 A * 6/1980 Melgaard ..... F27D 7/00 165/169
4,237,623 A * 12/1980 Timm ..... A47J 39/003 261/119.1
4,307,286 A * 12/1981 Guibert ..... A23L 3/365 126/21 A
4,336,443 A * 6/1982 Benedetto ..... F27D 11/02 126/21 A
4,345,143 A * 8/1982 Craig ..... F24C 7/04 219/386
4,350,140 A * 9/1982 Hamilton, Jr. ..... F24C 1/16 126/19.5
4,355,570 A * 10/1982 Martin ..... A47J 37/06 219/393
4,369,347 A * 1/1983 Shin ..... H05B 6/642 126/21 R
4,418,615 A * 12/1983 Higgins ..... F24C 1/04 126/21 A
4,420,679 A * 12/1983 Howe ..... F24C 15/325 126/21 A
4,439,459 A * 3/1984 Swartley ..... A23L 1/0114 126/21 A
4,444,175 A * 4/1984 Reynolds ..... F24C 15/32 126/21 R
4,446,780 A * 5/1984 Puvogel ..... A47J 39/003 99/480
4,450,344 A * 5/1984 Sakoda ..... H05B 6/642 110/163
4,468,424 A * 8/1984 Cartwright ..... A47G 23/04 426/109
4,479,776 A * 10/1984 Smith ..... A21B 1/245 219/388
4,483,243 A * 11/1984 Cote ..... A21C 13/00 219/401
4,489,375 A * 12/1984 Putman ..... F23N 1/022 266/80
4,489,376 A * 12/1984 Putman ..... F23N 1/022 266/80
4,492,839 A * 1/1985 Smith ..... A21B 1/245 126/21 A
4,500,950 A * 2/1985 Putman ..... G05B 13/0205 266/80
4,503,760 A * 3/1985 Pryputsch ..... F24C 15/322 126/21 A
4,525,137 A * 6/1985 Tomioka ..... F23N 5/003 126/116 A
4,559,312 A * 12/1985 Kim ..... C04B 35/64 264/434
4,585,923 A * 4/1986 Binder ..... F27B 17/02 126/21 A
4,608,474 A * 8/1986 Kohka ..... H05B 6/6473 219/681
4,608,961 A * 9/1986 Lanham, Jr. ..... A21B 1/24 126/21 A
4,622,231 A * 11/1986 Swartley ..... A23L 1/0114 426/438
4,664,026 A * 5/1987 Milloy ..... A47J 37/0704 99/352
4,751,368 A * 6/1988 Daifotes ..... A47J 36/2483 219/432
4,751,911 A * 6/1988 Betts ..... A47J 37/01 126/261
4,752,268 A * 6/1988 Kataoka ..... C03B 25/06 219/400
4,831,225 A * 5/1989 Ishifuro ..... H05B 6/6411 126/21 A
4,831,238 A * 5/1989 Smith ..... A21B 1/245 126/21 A
4,924,071 A * 5/1990 Jacobs ..... A23B 4/0053 219/400
4,963,091 A * 10/1990 Hoetzl ..... C21D 1/767 126/21 A

(56) References Cited

U.S. PATENT DOCUMENTS 4,972,824 A * 11/1990 Luebke ..... A21B 1/245 126/21 A
4,980,539 A * 12/1990 Walton ..... A47J 36/2461 219/386
5,050,578 A * 9/1991 Luebke ..... A21B 1/245 126/1 C
5,054,383 A * 10/1991 Cho ..... A21B 7/005 99/327
5,072,663 A * 12/1991 Ellis-Brown ..... A23B 4/0053 198/860.5
5,086,752 A * 2/1992 Hait ..... F24C 1/16 126/25 R
5,170,024 A * 12/1992 Hanatani ..... H05B 6/6482 219/494
5,172,682 A * 12/1992 Luebke ..... A21B 1/245 126/21 A
5,233,969 A * 8/1993 Koledin ..... F24C 1/16 126/19.5
5,241,947 A * 9/1993 Sandolo ..... A21B 1/24 126/21 A
5,254,823 A * 10/1993 McKee ..... H05B 6/808 126/21 A
5,360,965 A * 11/1994 Ishii ..... H05B 6/64 219/685
5,361,686 A * 11/1994 Koopman ..... F24C 15/322 126/21 A
5,365,039 A * 11/1994 Chaudoir ..... A21B 1/40 219/401
5,417,148 A * 5/1995 Cavallo ..... A47J 37/047 126/21 A
5,466,058 A * 11/1995 Chan ..... A47B 47/0075 312/107
D376,003 S * 11/1996 Hansen ..... A21B 1/40 D23/372
5,598,769 A * 2/1997 Luebke ..... A47J 37/042 99/395
5,609,095 A * 3/1997 Lemke ..... A47J 27/16 99/468
5,619,613 A * 4/1997 Otaki ..... A47J 39/00 219/402
5,674,425 A * 10/1997 Hong ..... H05B 6/6476 126/21 A
5,676,044 A * 10/1997 Lara, Jr. ..... A21B 1/245 126/21 A
5,676,051 A * 10/1997 Sinemus ..... A47J 39/003 99/448
5,717,192 A * 2/1998 Dobie ..... A21B 1/245 126/21 A
5,744,786 A * 4/1998 Kim ..... H05B 6/6447 219/494
5,783,803 A * 7/1998 Robards, Jr. ..... A47J 39/00 219/385
5,814,794 A * 9/1998 Lim ..... H05B 6/6435 126/21 A
5,826,496 A * 10/1998 Jara ..... A21B 1/245 126/21 A
5,866,877 A * 2/1999 Maetani ..... F26B 13/002 219/400
5,873,300 A * 2/1999 Kuhlman ..... A47J 36/2477 126/390.1
5,934,178 A * 8/1999 Caridis ..... A21B 1/245 126/21 A
5,937,845 A * 8/1999 Gladd, Sr. ..... A21B 1/26 126/21 A
5,948,301 A * 9/1999 Liebermann ..... A47J 36/2483 219/395
5,968,574 A * 10/1999 Sann ..... A47J 27/16 126/20
6,012,381 A * 1/2000 Hawn ..... A47J 27/14 126/25 R
6,041,773 A * 3/2000 Rosenquist ..... F24C 3/14 126/275 R
6,108,486 A * 8/2000 Sawabe ..... G11B 20/10 386/241
6,111,224 A * 8/2000 Witt ..... H05B 3/00 219/214
6,116,154 A * 9/2000 Vaseloff ..... A47J 39/02 219/214
6,121,583 A * 9/2000 Hansen ..... A21B 3/04 126/20
6,124,572 A * 9/2000 Spilger ..... A47B 88/08 219/394
6,142,066 A * 11/2000 Anders ..... A23B 4/052 99/386
6,166,353 A * 12/2000 Senneville ..... F24C 15/18 126/273 R
6,191,391 B1 * 2/2001 Deo ..... F24C 15/18 126/273 R
6,201,225 B1 * 3/2001 Lee ..... H05B 6/6444 126/21 A
6,259,067 B1 * 7/2001 Faries, Jr. ..... A61B 19/0248 219/394
6,265,695 B1 * 7/2001 Liebermann ..... A47J 36/24 219/214
6,278,098 B1 * 8/2001 Han ..... H05B 6/80 126/21 A
6,373,039 B2 * 4/2002 Lee ..... H05B 6/80 126/21 A
6,376,805 B2 * 4/2002 Faries, Jr. ..... A61F 7/0241 219/385
6,384,380 B1 * 5/2002 Faries, Jr. ..... A61G 12/001 219/385
6,414,283 B1 * 7/2002 McNamara ..... A47J 37/0635 219/383
6,433,323 B2 * 8/2002 Kim ..... H05B 6/80 126/21 A
6,444,955 B1 * 9/2002 Loveless ..... A47J 37/0623 126/21 A
6,484,512 B1 * 11/2002 Anderson ..... F25B 21/04 62/3.2
6,523,458 B1 * 2/2003 Turner ..... A47J 37/0871 219/386
6,586,714 B2 * 7/2003 Kawamura ..... H05B 6/745 219/494
6,612,116 B2 * 9/2003 Fu ..... F25D 17/042 62/186
6,652,732 B2 * 11/2003 Moulthrop ..... C25B 15/00 204/228.3
6,660,974 B2 * 12/2003 Faries, Jr. ..... A61F 7/0241 206/370
6,693,260 B1 * 2/2004 Rodrigues ..... F25D 23/12 165/58
6,849,835 B2 * 2/2005 Bollmers ..... F24C 15/18 219/400
6,860,261 B2 * 3/2005 Hines, Jr. ..... A21B 1/08 126/20
6,868,777 B1 * 3/2005 Higgins ..... A23B 4/044 426/314
6,987,246 B2 * 1/2006 Hansen ..... F24C 15/327 126/20
6,987,252 B2 * 1/2006 Graves ..... H05B 6/6473 126/21 A
7,087,873 B2 * 8/2006 Hayakawa ..... F24C 15/327 126/21 A
7,143,686 B1 * 12/2006 Sandolo ..... A23F 5/04 34/108
7,159,509 B2 * 1/2007 Starkey ..... F24B 1/202 126/25 R
7,235,762 B2 * 6/2007 Gagas ..... F24C 15/18 219/385
7,238,922 B2 * 7/2007 Andoh ..... F24C 15/327 126/20
7,279,659 B2 * 10/2007 Gagas ..... F24C 15/18 219/385
7,282,674 B2 * 10/2007 Hansen ..... F24C 15/327 126/190
7,421,942 B2 9/2008 Hansen et al.

(56) References Cited

U.S. PATENT DOCUMENTS 7,488,919 B2 * 2/2009 Gagas ..... F24C 7/087 219/400
7,596,882 B2 * 10/2009 Im ..... F26B 21/004 126/21 R
7,681,493 B2 * 3/2010 Moore ..... A23B 4/052 126/25 R
7,687,748 B2 * 3/2010 Gagas ..... H05B 6/1263 126/21 A
7,755,005 B2 * 7/2010 Bartelick ..... A23B 4/044 126/20
7,967,002 B2 * 6/2011 Inada ..... F24C 15/327 126/19 R
7,984,672 B1 * 7/2011 Yun ..... A23B 4/044 99/468
8,058,588 B2 * 11/2011 Gagas ..... A47J 36/2483 219/400
8,076,614 B2 * 12/2011 Baker ..... A23L 3/005 219/388
D655,805 S * 3/2012 Jonovic ..... F24C 15/327 D23/418
8,291,816 B2 * 10/2012 Iwamoto ..... A47J 39/00 219/391
8,479,440 B2 * 7/2013 DeMonte ..... A01M 1/2094 126/110 B
8,538,249 B2 * 9/2013 Shaffer ..... F24C 7/06 392/407
8,637,792 B2 * 1/2014 Agnello ..... A21B 1/48 219/388
8,851,061 B2 * 10/2014 Johnson ..... F24C 15/00 126/15 A
8,916,801 B2 * 12/2014 Harward ..... F24C 15/18 219/385
8,916,802 B2 * 12/2014 Bringe ..... A21B 1/22 219/385
8,921,742 B2 * 12/2014 Zhang ..... A47J 37/08 219/481
8,955,506 B2 * 2/2015 Murray ..... F24C 15/322 126/21 A
8,979,915 B2 * 3/2015 Wilford ..... F24C 15/18 417/199.1
2001/0004078 A1 * 6/2001 Lee ..... H05B 6/6473 219/757
2001/0054612 A1 * 12/2001 Kim ..... H05B 6/642 219/757
2004/0216732 A1 * 11/2004 McFadden ..... A21B 1/245 126/21 A
2005/0005781 A1 * 1/2005 Ohtsuka ..... F24C 15/325 99/476
2005/0178757 A1 * 8/2005 Starr ..... A47J 37/0814 219/386
2006/0043087 A1 * 3/2006 Gagas ..... F24C 15/18 219/391
2006/0225726 A1 * 10/2006 Andoh ..... F24C 15/2007 126/20
2006/0278629 A1 * 12/2006 Gagas ..... A47J 36/2483 219/385
2007/0102418 A1 * 5/2007 Swank ..... A21B 3/02 219/400
2007/0131215 A1 * 6/2007 McVeagh ..... A21B 1/245 126/21 A
2007/0137633 A1 * 6/2007 McFadden ..... A21B 1/245 126/21 A
2007/0138160 A1 * 6/2007 Ando ..... A21B 3/04 219/401
2007/0163567 A1 * 7/2007 Kaneko ..... F24C 15/006 126/21 A
2007/0187388 A1 * 8/2007 Yamaguchi ..... F22B 1/284 219/401
2007/0194004 A1 * 8/2007 Hansen ..... F24C 15/327 219/401
2007/0210058 A1 * 9/2007 Ando ..... A21B 3/04 219/401
2007/0210059 A1 * 9/2007 Ando ..... A21B 3/04 219/401
2008/0029081 A1 * 2/2008 Gagas ..... F24C 15/2035 126/299 D
2008/0066661 A1 * 3/2008 Berkenkoetter ..... F24C 7/087 110/162
2008/0066732 A1 * 3/2008 Berkenkoetter ..... F24C 7/087 126/21 A
2008/0099008 A1 * 5/2008 Bolton ..... A21B 1/245 126/21 A
2008/0110339 A1 * 5/2008 Kwok ..... F24C 15/2035 95/31
2008/0173631 A1 * 7/2008 Gagas ..... A47J 36/2483 219/400
2008/0223352 A1 * 9/2008 Ando ..... F24C 15/327 126/20
2008/0283519 A1 * 11/2008 McKee ..... H05B 6/6476 219/680
2009/0095739 A1 * 4/2009 McKee ..... H05B 6/6476 219/680
2009/0205625 A1 * 8/2009 Matsubayashi ..... F24C 15/327 126/21 A
2009/0236331 A1 * 9/2009 McKee ..... H05B 6/6473 219/681
2010/0064902 A1 * 3/2010 Sakane ..... F24C 15/327 99/352
2010/0310733 A1 * 12/2010 Hoffman ..... F24C 7/00 426/233
2011/0048245 A1 * 3/2011 Schjerven, Sr. ..... A21B 1/245 99/331
2011/0275023 A1 * 11/2011 Knight ..... A47J 37/0754 432/1
2012/0074121 A1 * 3/2012 Gagas ..... A47J 36/2483 219/385
2012/0272946 A1 * 11/2012 Phillips ..... F24C 15/2007 126/21 R
2013/0149947 A1 * 6/2013 Bagwell ..... F24C 15/20 454/49
2013/0153569 A1 * 6/2013 Ueki ..... F24C 15/006 219/688
2013/0284161 A1 * 10/2013 Johnson ..... F24C 15/325 126/21 A
2014/0007778 A1 * 1/2014 Marks ..... A23B 4/052 99/339
2014/0116267 A1 * 5/2014 Hochschild, Jr. ... A47J 36/2483 99/473

* cited by examiner

OVEN WITH AUTOMATIC OPEN/CLOSED SYSTEM MODE CONTROL

BACKGROUND OF THE INVENTION

The present invention relates to ovens for preparing food and in particular to an oven that may be automatically switched between "closed-system" operation with moisture substantially sealed within the cooking volume and "open-system" operation with moisture vented out of the cooking volume.

High-end commercial ovens may provide for closed-system operation in which the oven volume is substantially sealed to retain heat and moisture and provide energy savings. Such closed-system operation is particularly desirable for "combination ovens" that may cook food using steam and fan driven (forced convection) hot air but is also useful in convection ovens (without steam) and rotisserie ovens.

In closed-system ovens, expanding steam and air is vented so that the cooking process is performed without significant pressurization. This venting may occur through a condenser where the steam is cooled before exiting to the outside air, reducing the heating and humidification of the kitchen environment. In one common condenser design, the steam is passed through a water bath which cools and condenses the steam. The temperature of the water bath is monitored and fresh, cool water is introduced into the water bath as the temperature rises. Excess water from the bath passes through an overflow into the building drain system.

Closed-system operation may be undesirable for the preparation of some foods, for example bread items where a crisp crust is desired. In such cases, open-system operation may be approximated, for example, by opening the oven door by a small amount during cooking to allow the exchange of steam and exterior air. This approach wastes energy, produces undesirable venting of steam and heat into the food preparation area, and may promote uneven cooking. Increased venting of a closed-system oven may also be obtained by manually bypassing or disabling the condenser.

SUMMARY OF THE INVENTION

The present invention provides a closed-system oven that may be electronically switched between open-system and closed-system operation through motorized dampers that integrated into the normal closed-system condenser design. Electric control of the dampers allows the oven to vary not simply between closed-system and open-system operation for a given cooking session, but to switch states over the course of cooking as well as to switch periodically between states to provide precise humidity control.

In one embodiment, the invention provides an oven having an insulated housing and a door to access a cooking volume and further having a heater communicating with the cooking volume to heat the cooking volume. A damper is positioned between the interior cooking volume and exterior atmosphere to be electronically actuable, according to a signal controlling an opening of the damper, to controllably allow water vapor flow between the interior cooking volume and exterior atmosphere. An electronic computer executing a program stored in memory operates to vary the signal to the damper according to user-entered data.

It is thus a feature of at least one embodiment of the invention to provide for an oven that may automatically switch between closed-system and open-system cooking modes based on user input to optimize the cooking process.

The user-entered data may, in one example, indicate a type of food being prepared.

It is thus a feature of at least one embodiment of the invention to permit proper control of the operating mode of the oven to be inferred from a food type.

In this case, the electronic computer may provide a data structure mapping a type of food to particular control data defining control of the damper suitable for cooking the type of food.

It is thus a feature of at least one embodiment of the invention to provide a flexible way of incorporating an additional dimension of oven control into existing control structures related, for example, to a set of predetermined recopies.

Alternatively, the user-entered data may indicate a desired humidity.

It is thus a feature of at least one embodiment of the invention to provide an oven offering sophisticated direct control of humidity.

The control data used to control the damper may define a duty cycle indicating a proportion between a time span when the signal controls the damper to open and a time span when the signal does not control the damper to open.

It is thus a feature of at least one embodiment of the invention to implement humidity control by switching between closed-system and open-system operation.

The damper may include a pressure-activated bypass allowing flow of water vapor between the cooking volume and the exterior atmosphere regardless of the signal when a predetermined pressure difference between the cooking volume and the exterior atmosphere is reached. In one embodiment the predetermined pressure level may be a pressure difference of less than one pound per square inch.

It is thus a feature of at least one embodiment of the invention to reduce the possibility of pressure extremes in the cooking volume such as may promote seal leakage or interfere with operation of the oven door.

The damper may include a flapper valve biased to a closed position by a biasing element and includes an electronically actuable finger controlled by the signal, where the flapper valve biasing may be overcome by either of the movement of the finger against the flapper valve or by a gas pressure difference across the flapper value.

It is thus a feature of at least one embodiment of the invention to provide a damper that incorporates both electromechanical venting and pressure bypass in a single structure.

The damper may provide a first and second intake port and the signal received by the damper may operate to alternately control the damper to allow water vapor flow preferentially between the first intake port and the exterior atmosphere or to allow water vapor flow preferentially between the second intake port and the exterior atmosphere. The first intake port may communicate with the interior cooking volume directly and the second intake port may communicate with the interior cooking volume through a steam trap.

It is thus a feature of at least one embodiment of the invention to provide an automated damper system that may integrate with a steam trap of the type suitable for closed-system oven operation.

The oven may include a motorized fan generating at least two regions of relative high and low pressure within the interior cooking volume and the first damper may have a port receiving water vapor from the region of relative high pressure and expelling it to the exterior atmosphere. The oven may further include a second similar damper positioned between the interior cooking volume and exterior atmosphere having a port at the region of relative low pressure for drawing air from the exterior atmosphere into the interior cooking volume. The electronic computer may also provide the second signal to the second damper.

It is thus a feature of at least one embodiment of the invention to provide a fan-assisted "flow-through" venting system for rapid humidity reduction.

These particular objects and advantages may apply to only some embodiments falling within the claims and thus do not define the scope of the invention.

DETAILED DESCRIPTION OF THE PREFERRED EMBODIMENT

Figure 1:
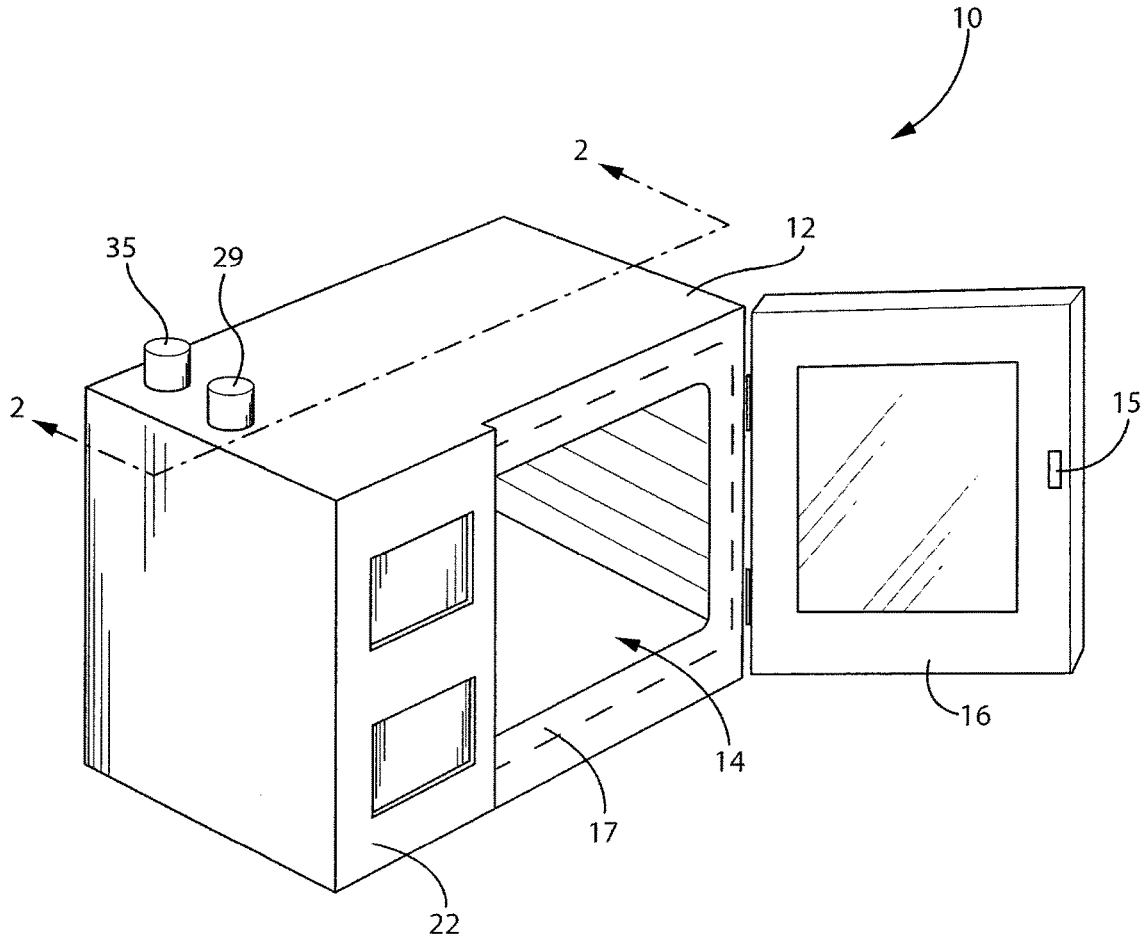
FIG. 1 is a simplified perspective view of a combination oven suitable for use with the present invention showing a housing having an openable door to reveal a cooking volume and showing a user interface on a front surface of the oven.

Referring now to FIG. 1, a mode control oven 10 according to one embodiment of the present invention may provide a housing 12 defining a cooking volume 14. Sidewalls of the cooking volume 14 may provide for rack supports 11 holding conventional cooking racks for supporting pans or trays of food.

The cooking volume 14 may be accessed through a door 16 connected by a hinge at one vertical side of the cooking volume 14. The door 16 may close over the cooking volume 14 during the cooking operation as held by a latch assembly 15 (visible on the door 16 only). In the closed position, the door 16 may substantially seal against the cooking volume 14 by compressing a gasket 17 surrounding an opening of the cooking volume 14 in the housing 12.

At one side of the cooking volume 14, the housing 12 may support a control panel 22 accessible by a user standing at a front of the oven 10. The control panel 22 may provide conventional electronic controls such as switches, buttons, a touchscreen or the like that may receive oven control data from the user as will be described below.

Figure 2:
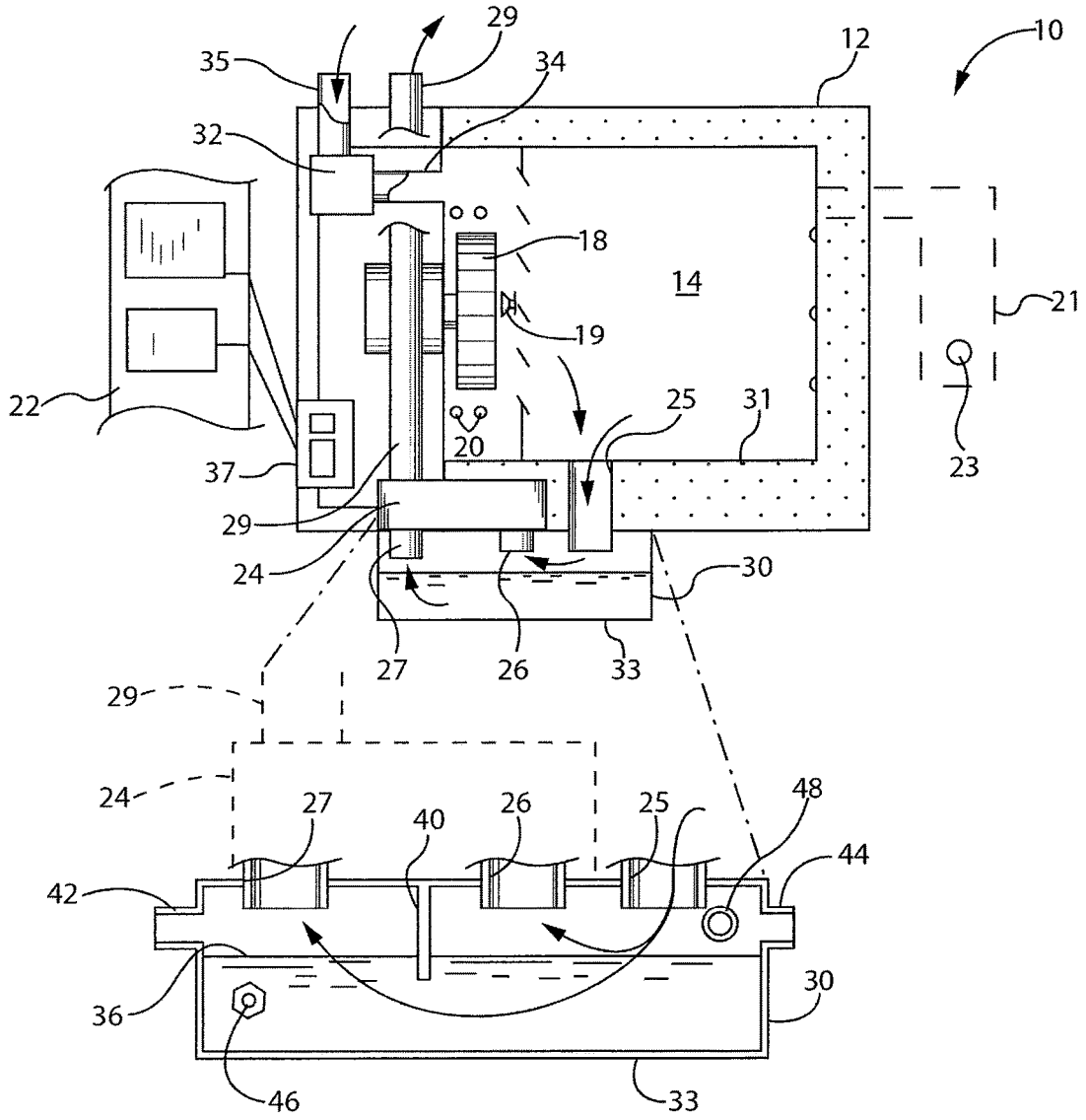
FIG. 2 is a section along line 2-2 of FIG. 1 showing an internal convection fan, heater unit, and condenser unit of the oven and showing motorized intake and exhaust dampers according to one embodiment of the present invention and further showing an expanded cross-sectional view of the condenser unit.

Referring now also to FIG. 2, positioned within the housing 12 and communicating with the cooking volume 14 is a motor-driven convection fan 18 directing a stream of air across a heater element 20 into the cooking volume 14. The heater element 20 may be an electric heating element or a heat exchanger receiving heat from a gas flame or the like and may surround the convection fan 18. In one embodiment, steam may be produced by a valve-controlled water jet 19 directing a spray of water on the fan 18 and the heater element 20 proximate to the fan 18.

Alternatively steam may be provided by a separate boiler 21 having a dedicated heater element 23 and communicating with the cooking volume 14.

Ovens of this type are commercially available from the Alto-Shaam Inc. of Menomonee Falls, Wis. and are described generally in U.S. Pat. No. 6,188,045 "Combination Oven with Three Stage Water Atomizer" hereby incorporated by reference.

Referring still to FIG. 2, a bottom wall 31 of the cooking volume 14 may provide a drainpipe 25 extending downwardly from the bottom wall 31 to a condenser chamber 30 positioned beneath the bottom wall 31. The drainpipe 25 may extend vertically (as shown) or may extend horizontally for a short distance before or after it is received within the condenser chamber 30.

In either case, the drainpipe 25 allows steam and water vapor to enter the condenser chamber 30 which provides a generally enclosed box whose upstanding sidewalls retain a pool of water having a water level 36. The lower end of the drainpipe 28 passing into the condenser chamber 30 stops above the bottom wall 33 and above a water level 36.

The condenser chamber 30 may in turn communicate generally with a first electronically controllable, exhaust damper 24 through either of a bypass port 26 or a condenser port 27 of the exhaust damper 24 passing through an upper wall of the condenser chamber 30. The motorized exhaust damper 24 communicates with an exhaust pipe 29 venting to the atmosphere outside of the housing. The exhaust damper 24 operates to determine through which of these ports (the bypass port 26 or condenser port 27) water vapor may pass in exiting the condenser chamber 30 through an exhaust pipe 29 to the outside atmosphere.

A second electronically controllable intake damper 32 is positioned with its exhaust port 34 near the fan 18 to permit outside air to be drawn into the cooking volume 14 from an intake pipe 35 extending to the external atmosphere outside the housing 12. In this regard, the exhaust port 34 of the intake damper 32 will be in a low-pressure region of the cooking volume 14 when the fan 18 is operating. Conversely, the drainpipe 25 feeding the ports 26 and 27 will be in a high-pressure region of the cooking volume 14 (when the fan 18 is operating) having a higher pressure than the low-pressure region. In this way when the motorized dampers 24 and 32 are open, air is actively drawn from the outer atmosphere into the cooking volume 14 through intake damper 32 and exhausted through drainpipe 25, condenser chamber 30, and exhaust damper 24. It will be appreciated generally, therefore, that closing the motorized intake damper 32 and motorized exhaust damper 24 allows the oven 10 to operate in a conventional closed-system state to provide for high humidity, low heat loss, and low flavor transfer. Conversely opening motorized dampers 24 and 32 allows the oven 10 to operate in an open state providing low humidity. It will be appreciated that the motorized dampers 24 and 32 may be operated cyclically to open and close to provide for gradations between these two operating point extremes.

Referring to FIGS. 1 and 2, a controller board 37 within the housing 12 may receive user input data from the control panel 22 for control of the oven 10. As will be discussed in greater detail below, the controller board 37 generally provides an electronic computer executing a program stored in computer memory to control the heater element 20, fan 18, and the water jet 19, and the motorized dampers 24 and 32, turning the latter on and off as necessary to implement a particular cooking schedule.

As shown in FIG. 2, the condenser chamber 30 may provide for an overflow port 42 that generally connects to the sanitary sewer line but with some venting arrangement which allows the escape of gases. For example, the exhaust port 34 may discharge onto a floor drain or the like. Water in the condenser chamber 30 may be maintained at a cool temperature by a freshwater inlet 44 adding makeup water through a valve (not shown) also under the control of the controller board 37 which may further communicate with a temperature gauge 46 so that additional water is added through the inlet 44 only when the temperature of the existing water rises above a certain amount. As water is admitted through inlet 44, excess water drains out through the overflow port 42 which provides an overflow lip 47 defining the water level 36. Steam passing through the drainpipe 25 may also pass into a steam collection port 48 that may recirculate back to the cooking volume 14. The steam collection port 48 may hold a temperature sensor (not shown) communicating with the controller board 37 which may be used to provide steam temperature information useful for control of the oven 10.

A variation on this design is shown in U.S. patent application Ser. No. 13/306,687 filed Nov. 29, 2011, entitled "Grease Handling Apparatus for Closed-system Oven" assigned to the same assignee as the present invention and hereby incorporated by reference.

Importantly, the internal volume of the condenser chamber 30 is divided by a vertical baffle plate 40 extending down from an upper wall of the condenser chamber 30 below the water level 32 but above the bottom of the condenser chamber 30. This baffle plate 40 provides two distinct paths of water vapor flow from the cooking volume 14 depending on a state of operation of the exhaust damper 24. In a first path, water vapor passing into the condenser chamber 30 through the drainpipe 25 may pass out of a bypass port 26 without flowing through the water. Alternatively, in a second path, water vapor passing into the condenser chamber 30 through drainpipe 25 may flow through the water and beneath the vertical baffle plate 40 to condense any steam in that flow. This latter path introduces some back pressure resulting from a resistance to gas flow through the water and therefore tends to retain moisture within the cooking volume 14 while providing a release of excess pressure only.

Accordingly, the state of operation of the exhaust damper 24 may provide either a low resistance direct venting of the cooking volume 14 to the outside atmosphere (as will be used for open-state operation) or a higher resistance in direct venting of the cooking volume 14 through the water of the condenser chamber 30 (as will be used for closed-state operation).

Figure 3:
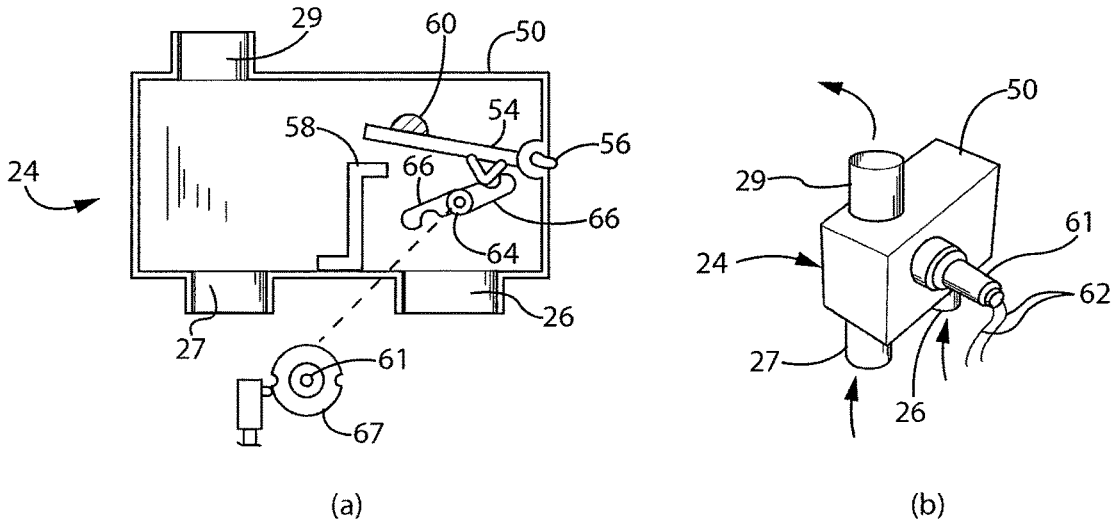
FIGS. 3*a* and 3*b* are a vertical elevational cross-sectional view and a perspective view of the exhaust damper of FIG. 2.

Referring now to FIG. 3, in this regard, motorized exhaust damper 24 may provide for a generally enclosed manifold 50 joining the intake ports 26 and 27 and exhaust pipe 29. The housing may be divided by a flapper valve 52 comprising a valve plate 54 pivoting at pivot point 56 attached between an upper edge of the valve plate 54 and a lower surface of an upper wall of the manifold 50. The valve plate 54 is normally pressed against a valve seat 58 by a biasing element 60 such as a weight. When so biased against the valve seat 58, the intake port 26 is isolated from the port 27 and an exhaust pipe 29.

A gearmotor 61 having motor leads 62 receiving control signals from the controller board 37 may drive a hub 64 extending into the manifold 50 having diametrically opposed radially extending fingers 66 attached to rotate with the hub 64. In one direction of rotation, indicated by an arrow in FIG. 3, the one of the fingers 66 may press against the valve plate 54 to lift it away from the valve seat 58 against the biasing element 60 to allow flow of water vapor through port 26 to exhaust pipe 29. This flow will be preferred over a flow through condenser port 27 because of the lack of back resistance from the water in the condenser chamber 30. When the gearmotor 61 continues rotation, the finger 66 is removed from the valve plate 54 allowing it to close under the influence of the biasing element 60. At this point water vapor must flow primarily through port 27 to reach exhaust pipe 29 and thus through the water of the condenser chamber 30.

The gearmotor 61 may have a cam 67 communicating with a limit switch 68 or other sensor allowing the controller board 37 to accurately control the finger 66 to stop motion with the valve plate 54 alternately at an open and closed position corresponding to an open and closed system state of the oven as will be further described.

Figure 4:
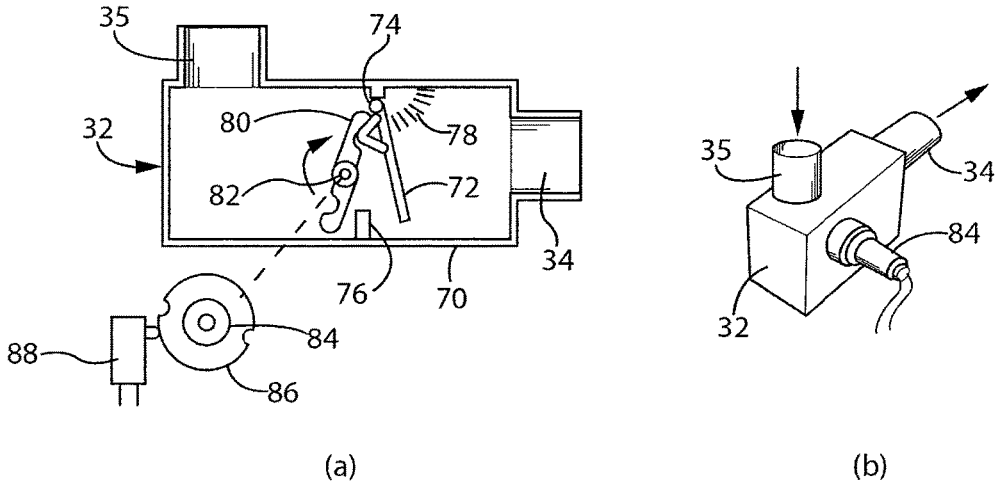
FIGS. 4*a* and 4*b* are figures similar to that of FIGS. 3*a* and 3*b* of the intake damper of FIG. 2.
Figure 5:
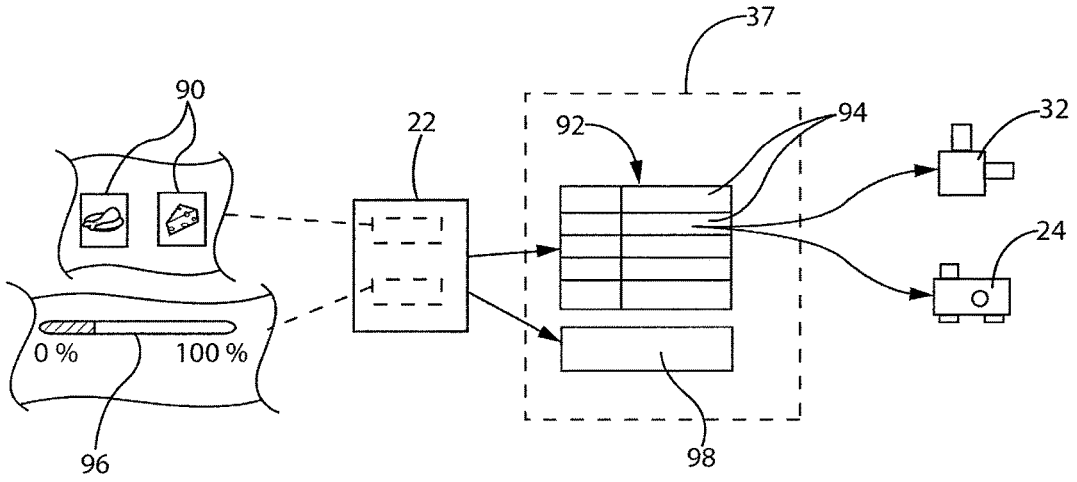
FIG. 5 is a data flow diagram showing control of the dampers through the user interface of FIG. 1.

Referring now to FIG. 4, the motorized intake damper 32 may likewise provide a manifold 70 divided internally by valve plate 72 pivoting at its upper edge about pivot 74 attached to an inner upper surface of the manifold 70. The valve plate 72 is normally held against a valve seat 76 as biased by biasing element 78, in this case depicted as a spring. In a manner similar to that described above, fingers 80 attached to a hub 82 driven by a gearmotor 84 may control opening of the valve plate 72 under the control of the controller board 37. For the purpose of this control, the gearmotor 84 may include a cam 86 and limit switch 88 providing signals to the controller board 37. In motorized intake damper 32, the valve plate 72, when closed, separates the exhaust port 34 from the intake pipe 35, and when open allows free flow of gas between the intake pipe 35 and exhaust port 34.

Figure 6:
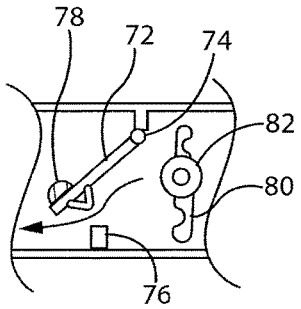
FIG. 6 is a partial fragmentary view of a flapper valve of either FIG. 3 or 4 showing bypass venting occurring with a predetermined pressure difference across the damper.

Referring now to FIG. 6, generally the valve plate 72 (or 54) may be opened against the force of its biasing element 78 (or 60) simply by differential pressure across the valve plate 72 when the valve plate 72 is closed. The valve plate 72 (or 54) and its biasing element 78 (or 60) may be calibrated to open on excess pressure difference of about one quarter pound per square inch and desirably less than one pound per square inch. This effectively built-in bypass valve functionality provides automatic pressure relief preventing excess positive or negative pressure from arising in the cooking volume 14. For this bypass operation, the valve plate 54 should swing away from the valve seat 58 in opening toward the exhaust pipe 29 whereas the valve plate 72 in opening away from valve seat 76 should swing toward exhaust port 34.

Referring now to FIG. 9, electronic control of the motorized dampers 24 and 32 may be implemented on the controller board 37 by an electronic processor executing a stored program to receive user-entered data from the control panel 22. In one embodiment, the control panel 22 as controlled by the controller board 37 may display different food icons 90, for example on multiple membrane switches or a touch panel, representing different foods in the form of different prepared dishes or particular foodstuffs subject to different cooking techniques. Each of these icons may be mapped by a data structure 92 (for example, a data table) to a particular control strategy 94. This data table may be preset at the factory or set by an individual user.

The control strategies 94 of the data structure 92 define an opening or closing of motorized dampers 24 and 32 according to a cooking schedule desired for cooking the food indicated by the icons 90. In simple cases, both motorized dampers 24 and 32 will be fully open or fully closed during an entire cooking cycle according to the control strategy 94; however, more complicated control strategies may change the state of the dampers 24 and 32 in tandem during the cooking process, for example, to begin with a high humidity cooking process and end with the low humidity cooking process.

Alternatively, the control panel 22 may present a humidity control 96 to the user, for example, providing for a bar display between zero and 100 percent humidity whose setting may be moved by a swiping gesture on a touchscreen or the like. This user-input humidity value may be provided to a procedural control function 98 operating on the controller board 37 which opens and closes the dampers 24 and 32 according to the desired humidity value.

Figure 7:
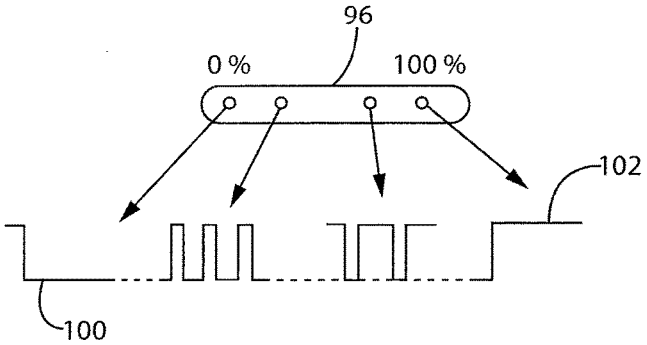
FIG. 7 is a timing diagram of damper operation according to different settings of a user interface for humidity control.

Referring to FIG. 7, for example, when a zero percent humidity is desired, a first signal state 100 may be provided to the motorized dampers 24 and 32 (shown arbitrarily as a low state) causing them both to open and stay open indefinitely. Conversely, when 100 percent humidity is selected, a second signal state 102 may be provided to the motorized dampers 24 and 32 (again shown arbitrarily as a high state) causing them both to open indefinitely. For humidity between these values, the procedural function 98 may implement duty cycle control of the motorized dampers 24 and 32 switching between high and low states in time proportion dependent on the humidity. Thus, for low nonzero humidity, state 100 predominates whereas for high humidity but less than 100 percent humidity, state 102 predominates. The switching may occur, for example, on a periodic basis on the order of once every minute.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a control board" and "a processor" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

What we claim is:

1. A food cooking oven comprising:

an insulated housing including a door closing to define an interior cooking volume in a substantially sealed first state and opening to provide access to the cooking volume in a substantially unsealed second state;

a heater communicating with the cooking volume to heat the cooking volume;

a steam generator generating steam from a source of introduced water, being electronically actuable to receive a signal controlling a generation of steam;

a first damper positioned between the interior cooking volume and exterior atmosphere, and in the substantially sealed first state being electronically actuable to receive a signal controlling an opening of the damper to allow water vapor flow between the interior cooking volume and exterior atmosphere and providing a pressure-activated bypass allowing flow of water vapor between the interior cooking volume and the exterior atmosphere when a predetermined pressure difference between the cooking volume and the exterior atmosphere is reached; and an electronic computer executing a program stored in memory to vary the signal to the damper according to user-entered data and to vary the signal to the steam generator according to user-entered data.

2. The oven of claim 1 wherein the user-entered data indicates a type of food.

3. The oven of claim 1 further including a user interface receiving the user-entered data and wherein the electronic computer provides a data structure mapping a type of food to control data defining control of the damper suitable for cooking the type of food.

4. The oven of claim 1 wherein the user-entered data indicates a desired humidity.

5. The oven of claim 4 wherein the user-entered data is converted to control data of a duty cycle defining a proportion between a time when the signal controls the damper to open and a time when the signal does not control the damper to open.

6. The oven of claim 1 wherein the predetermined pressure difference is a pressure difference of less than one atmosphere.

7. The oven of claim 6 wherein the damper includes a flapper valve biased to a closed position by a biasing element and includes an electronically actuable linger controlled by the signal, where the flapper valve biasing may be overcome by a movement of the finger against the flapper valve or by a gas pressure difference across the flapper value.

8. The oven of claim 7 wherein the biasing element is selected from the group consisting of a weight and a spring.

9. The oven of claim 1 wherein the damper provides a first and second intake port and wherein the signal received by the damper operates, to alternately control the damper to allow water vapor flow preferentially between the first intake port and the exterior atmosphere and to control the damper to allow water vapor to flow preferentially between the second intake port and the exterior atmosphere, wherein the first intake port communicates with the interior cooking volume directly and the second intake port communicates with the interior cooking volume through a steam trap.

10. The oven of claim 9 wherein the steam trap is a container holding water through which the water vapor must flow in passing from the interior cooking volume to the exterior atmosphere.

11. The oven of claim 9 wherein the damper includes a flapper valve biased to a first position by a biasing element blocking water vapor flow through the first intake port and includes an electronically actuable finger controlled by the signal, where the flapper valve biasing may be overcome by a movement of the finger against the flapper valve or by a gas pressure difference across the flapper value to allow flow through the second intake port regardless of the signal.

12. The oven of claim 11 wherein the biasing element is selected from the group consisting of a weight and a spring.

13. The oven of claim 1 wherein the oven includes a motorized fan generating at least two regions of relative high and low pressure within the interior cooking volume and wherein the first damper has a port receiving water vapor from the region of relative high pressure expelling it to the exterior atmosphere; and further including a second damper positioned between the interior cooking volume and exterior atmosphere, being electronically actuable to receive a second signal controlling an opening of the second damper to allow water vapor flow between the interior cooking volume and exterior atmosphere, the second damper having a port at the region of relative low pressure for drawing air from the exterior atmosphere into the interior cooking volume; and wherein the electronic computer provides the second signal to the second damper.

14. The oven of claim 13 wherein the second damper includes a pressure-activated bypass allowing flow of water vapor between the cooking volume and the exterior atmosphere regardless of the signal when a predetermined pressure difference is achieved.

15. The oven of claim 14 wherein the predetermined, pressure difference is a pressure difference of less than one atmosphere.

16. The oven of claim 15 wherein the second damper provides a flapper valve biased to a closed position by a biasing element and includes an electronically actuable finger, where the flapper valve biasing may be overcome by movement of the finger against the flapper valve or by a pressure difference.

17. The oven of claim 13 wherein the first signal and the second signal operate to simultaneously open and close the first damper and the second damper.

18. The oven of claim 1 further including a convection fan for circulating heated air within the interior volume.

* * * * *